US007571874B2

(12) United States Patent
Zhang et al.

(10) Patent No.: US 7,571,874 B2
(45) Date of Patent: Aug. 11, 2009

(54) WIRE WINDING DEVICE WITH SPRING LOADED RETRACTABLE WIRE REEL

(75) Inventors: Jun Zhang, Shenzhen (CN); Zheng Shi, Shenzhen (CN); Chien-Li Tsai, Tu-Cheng (TW); Chun-Chi Liang, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 262 days.

(21) Appl. No.: 11/309,544

(22) Filed: Aug. 18, 2006

(65) Prior Publication Data

US 2007/0138329 A1 Jun. 21, 2007

(30) Foreign Application Priority Data

Dec. 16, 2005 (CN) ..... 2005 2 0120567

(51) Int. Cl.
*B65H 75/30* (2006.01)
*B65H 75/48* (2006.01)

(52) U.S. Cl. ..... 242/385.1; 242/385.2; 242/385.3; 242/385.4; 242/379; 191/12 R; 160/243; 160/323.1

(58) Field of Classification Search ..... 242/379, 242/375, 385.1–385.4, 371; 191/12 R; 160/243, 160/246, 323.1; *B65H 75/30*
See application file for complete search history.

(56) References Cited

U.S. PATENT DOCUMENTS

| | | | | |
|---|---|---|---|---|
| 3,219,288 | A * | 11/1965 | Fritz | 242/370 |
| 5,226,467 | A * | 7/1993 | Lii | 160/302 |
| 5,299,670 | A * | 4/1994 | Willard | 191/12.2 R |
| 5,354,011 | A * | 10/1994 | Rozon | 242/402 |
| 5,839,686 | A * | 11/1998 | Dybro et al. | 242/374 |
| 5,918,658 | A * | 7/1999 | Schartner | 160/178.1 R |
| 5,934,534 | A * | 8/1999 | Schmidt et al. | 225/4 |
| 7,000,746 | B2 | 2/2006 | Mackin et al. | |
| 7,001,210 | B1 | 2/2006 | Chiang | |
| 2005/0173581 | A1 * | 8/2005 | Stevens | 242/374 |

* cited by examiner

*Primary Examiner*—Peter M Cuomo
*Assistant Examiner*—Stefan Kruer
(74) *Attorney, Agent, or Firm*—Wei Te Chung

(57) ABSTRACT

A wire winding device includes a case, a reel received in the case for winding a wire thereon, a restricting member for restricting/releasing the reel, and a resilient member for interconnecting the case and the reel and rotating the reel and being movable with reel in an axis direction of the reel when the reel starts to rotate.

20 Claims, 7 Drawing Sheets

WIRE WINDING DEVICE WITH SPRING LOADED RETRACTABLE WIRE REEL

FIELD OF THE INVENTION

The present invention relates to wire winding devices, and particularly to a wire winding device with a spring loaded retractable wire reel.

DESCRIPTION OF RELATED ART

Wires are necessary parts in consumer electronics, such as computers, modems, telephones, and fax machines, and are often used for connecting two or more such devices. However, if the wires are too long they will often become tangled, causing great inconvenience.

To avoid this shortcoming, a kind of automatic wire winding device has been proposed. The wire winding device generally includes a housing, a winding disk or reel, a scroll spring, and a swing plate. The winding disk is a circular disk and received in the housing. The scroll spring is positioned in the housing and includes a fastening end fastened with the winding disk so that the scroll spring and the winding disk can be joined. When the winding disk turns, the scroll spring stores energy. In practical use, the wire is pulled out directly from the housing storing energy in the spring. When the swing plate is driven to release the winding disk, the stored energy is released and the spring recoils urging the reel to rotate, thus rewinding the wire.

However, the wire winding device is complicated because an additional actuator, such as a button, is needed to drive the swing plate, and is inconvenient because the user has to operate the additional actuator to rewind the wire.

What is needed, therefore, is a wire winding device with simple and convenient properties.

SUMMARY OF THE INVENTION

A wire winding device includes a case, a reel received in the case for winding a wire thereon, a restricting member for restricting/releasing the reel, and a resilient member for interconnecting the case and the reel and rotating the reel and being movable with reel in an axis direction of the reel when the reel starts to rotate.

Other advantages and novel features will become more apparent from the following detailed description when taken in conjunction with the accompanying drawings, in which:

DETAILED DESCRIPTION OF THE INVENTION

In the following embodiment, a wire winding device applied in a digital camera is used as an example for illustration. It is noted that the wire winding device in the embodiment may be also applied in a computer, a modem, a telephone or any other electronic apparatus.

Figure 1:
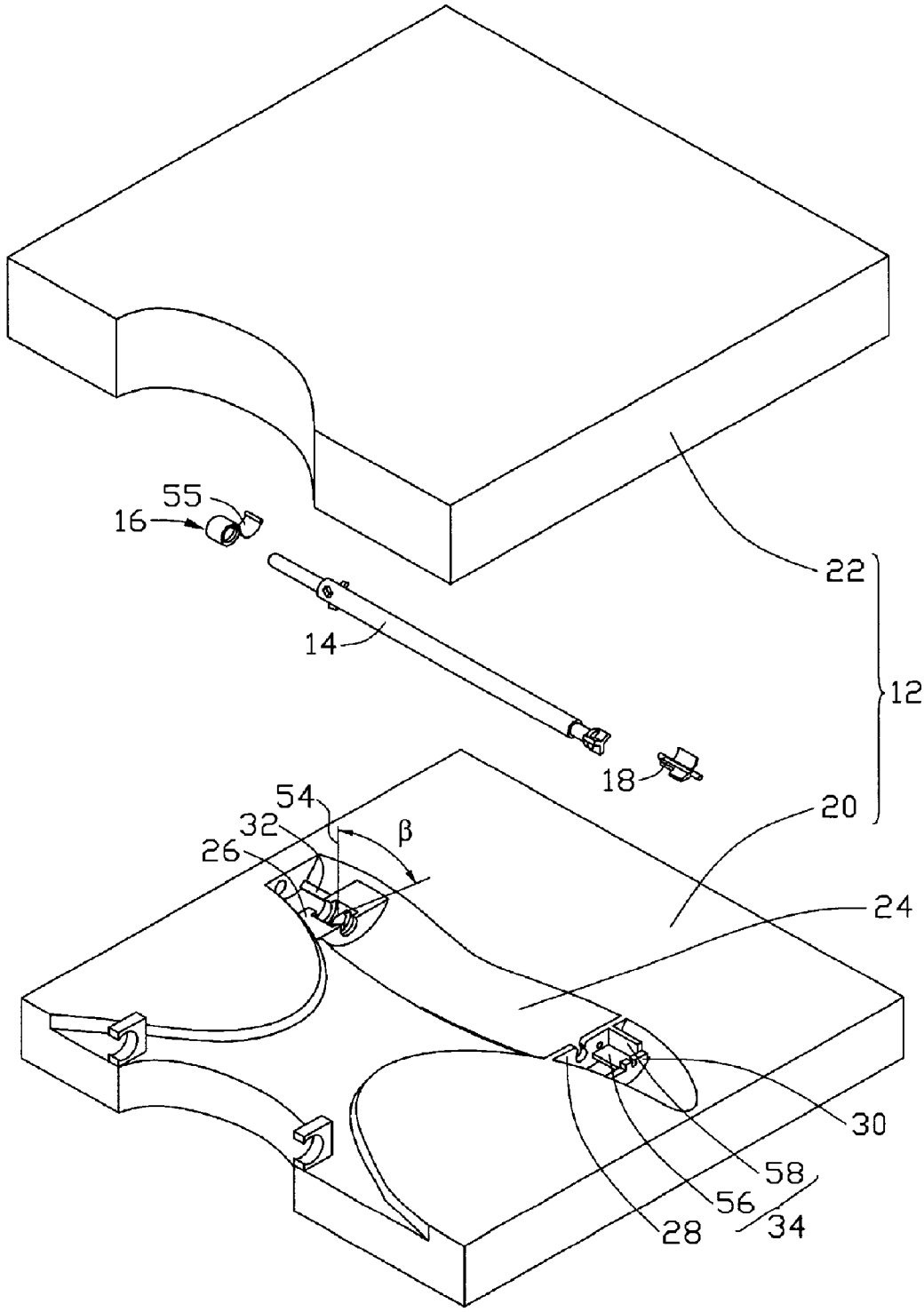
FIG. 1 is an exploded, isometric view of a wire winding device in accordance with a preferred embodiment.

Referring to FIG. 1, a wire winding device in accordance with a preferred embodiment includes a housing 12, a reel 14, a scroll spring 16, and a resilient lock 18. The housing 12 includes a first case 20 and a second case 22 coupled to the first case 20. The reel 14, the scroll spring 16, and the resilient lock 18 are accommodated in the housing 12.

Figure 2:
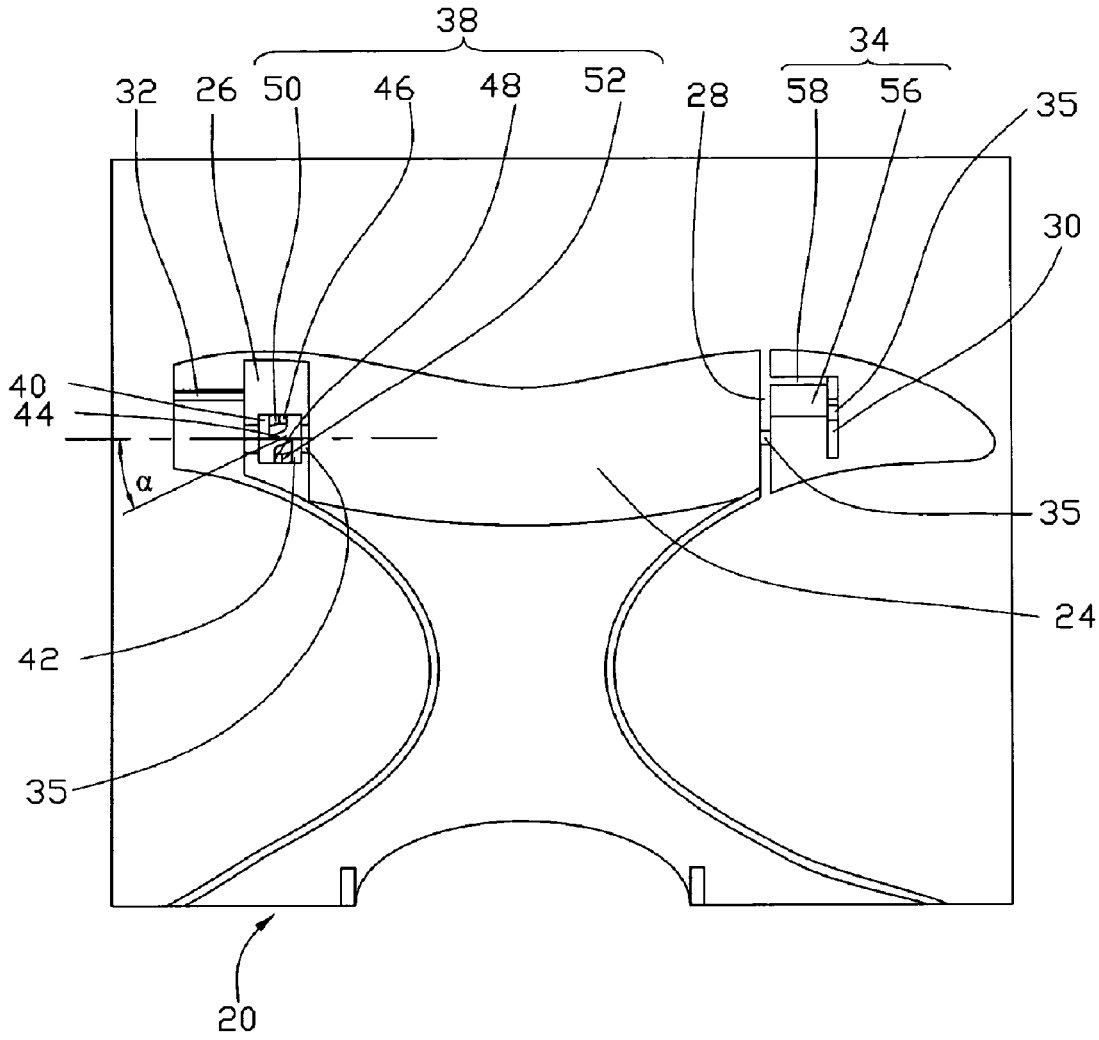
FIG. 2 is a top view of a first case of FIG. 1.
Figure 3:
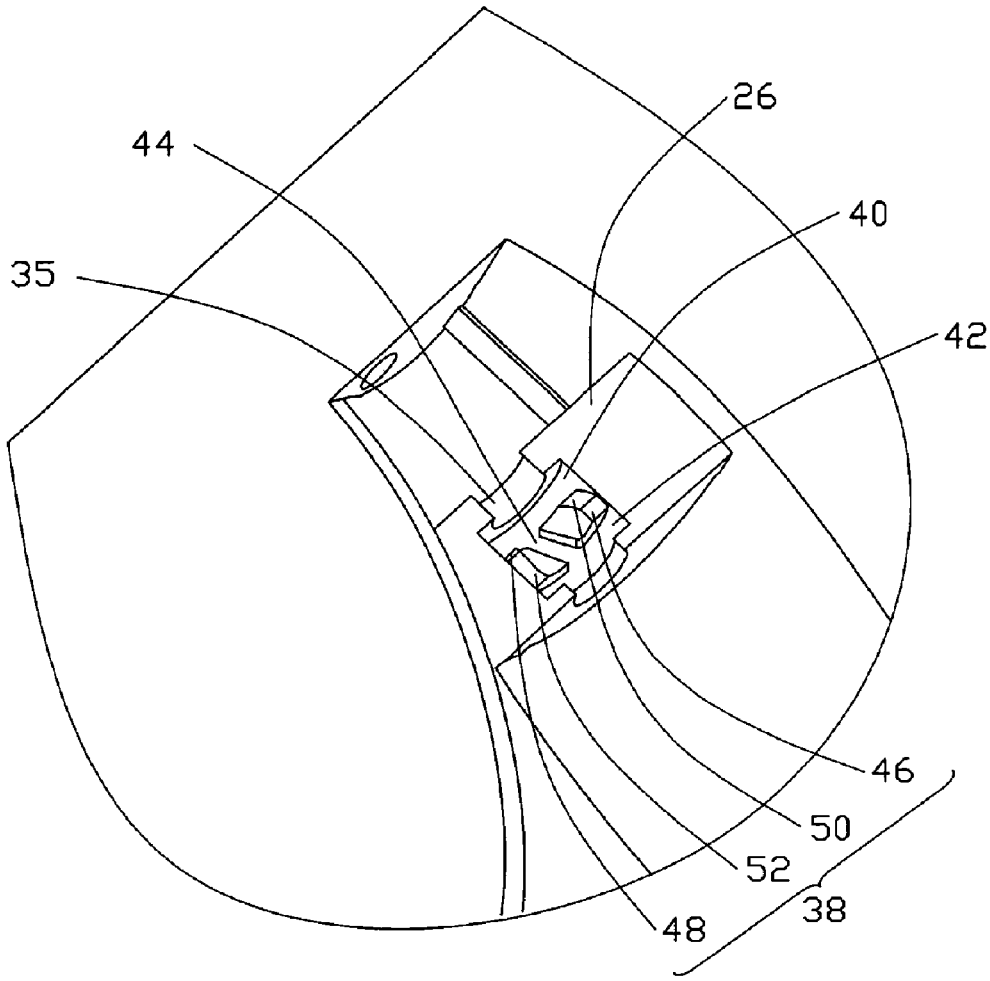
FIG. 3 is an enlarged, exploded, isometric view of part of the first case of FIG. 1.

Referring also to FIGS. 2 and 3, the first case 20, which defines an elongated recess portion 24 therein, includes a first shoulder 26, a second shoulder 28, a third shoulder 30, a fixing sheet 32, and an L-shaped sheet 34. The first shoulder 26, the second shoulder 28 and the third shoulder 30 are spaced from and substantially parallel to each other, and arranged in series in the recess portion 24 along its longitudinal direction. A plurality of fixing holes 35 are respectively defined in the first shoulder 26, the second shoulder 28, and the third shoulder 30 for receiving the reel 14 and the resilient lock 18. The first shoulder 26 includes a wedge portion 38. A first receiving groove 40 and a second receiving groove 42 are defined in the first shoulder 26 and arranged at two opposite sides of the wedge portion 38. A sliding channel 44 is defined through the wedge portion 38 for communicating the first receiving groove 40 and the second receiving groove 42. A first acute angle $\alpha$ is defined between a center-line direction of the sliding channel 44 and an axial direction of the reel 14. The sliding channel 44 divides the wedge portion 38 into two parts named as a first wedge subportion 46 and a second wedge subportion 48. The first wedge subportion 46 and the second wedge subportion 48 are staggered along the axial direction of the reel 14. The first wedge subportion 46 includes a first inclined surface 50 adjacent to the first receiving groove 40 and oriented such that a lower end of the first inclined surface 50 is nearest the first receiving groove 40. The second wedge subportion 48 includes a second inclined surface 52 adjacent to the second receiving groove 42 and oriented such that a lower end of the second inclined surface 52 is nearest the second receiving groove 42. A second acute angle $\beta$ is defined between the first inclined surface 50 and a supposed plane 54 perpendicular to the axial direction of the reel 14. Between the second inclined surface 52 and the plane 54, another second acute angle $\beta$ is also defined. At least one end of the fixing sheet 32 is secured to the recess portion 24. A first interspace (not labeled) is defined under the fixing sheet 32 and between the fixing sheet 32 and the recess portion 24 allowing a free end 55 of the scroll spring 16 to be inserted therethrough. The L-shaped sheet 34 interconnects the second shoulder 28 and the third shoulder 30 and includes a first baffle sheet 56 and a second baffle sheet 58 perpendicularly extending from the first baffle sheet 56.

Figure 4:
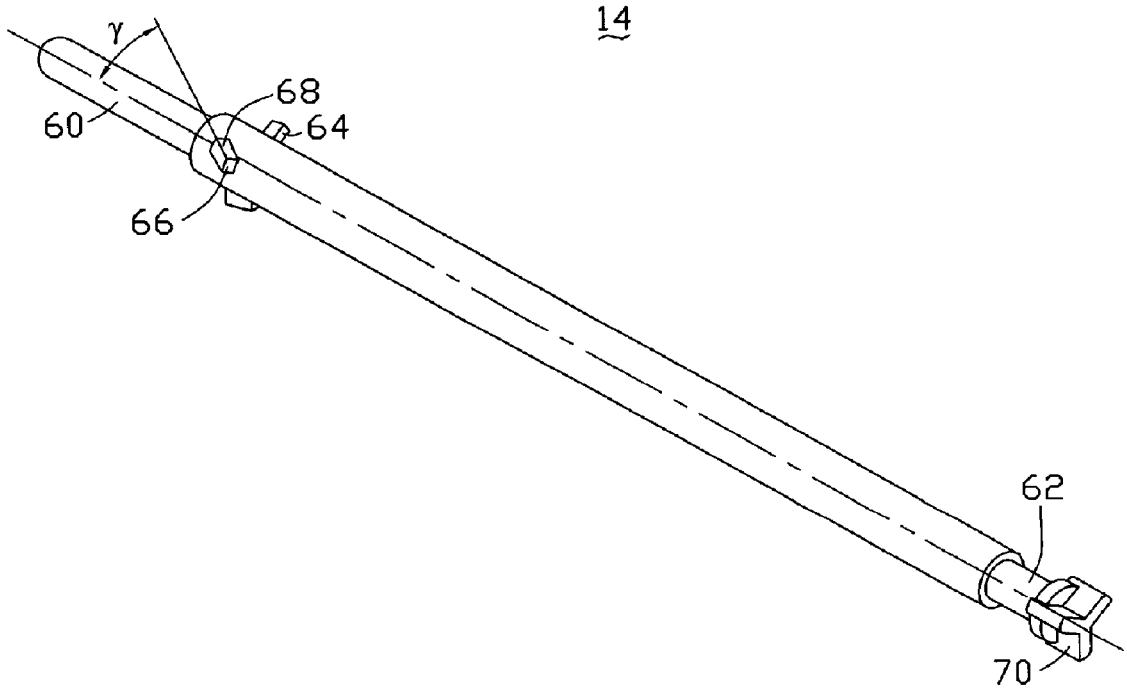
FIG. 4 is an enlarged, isometric view of a reel of FIG. 1.

Referring also to FIG. 4, the reel 14 includes a first end portion 60 supported by the first shoulder 26 and an opposite end portion 62 supported by the second shoulder 28. Three guiding teeth 64 extend from the outer circumference of the reel 14 in equal radians and are adjacent to the first end portion 60. The three guiding teeth 64 can be rotated and moved into the first receiving groove 40 or the second receiving groove 42 via the sliding channel 44. Each guiding tooth 64 includes two opposite first sides 66 and two opposite second sides 68. Each first side 66 is perpendicular to the axial direction of the reel 14. A third acute angle $\gamma$ is defined between each second side 68 and the axial direction of the reel 14. The third acute angle $\gamma$ is substantially equal to the first acute angle $\alpha$, or is less than or equal to the second acute angle β. Three first blocking sheets 70 extend from an axis of the reel 14 in equal radians and are arranged at the second end portion 62.

Figure 5:
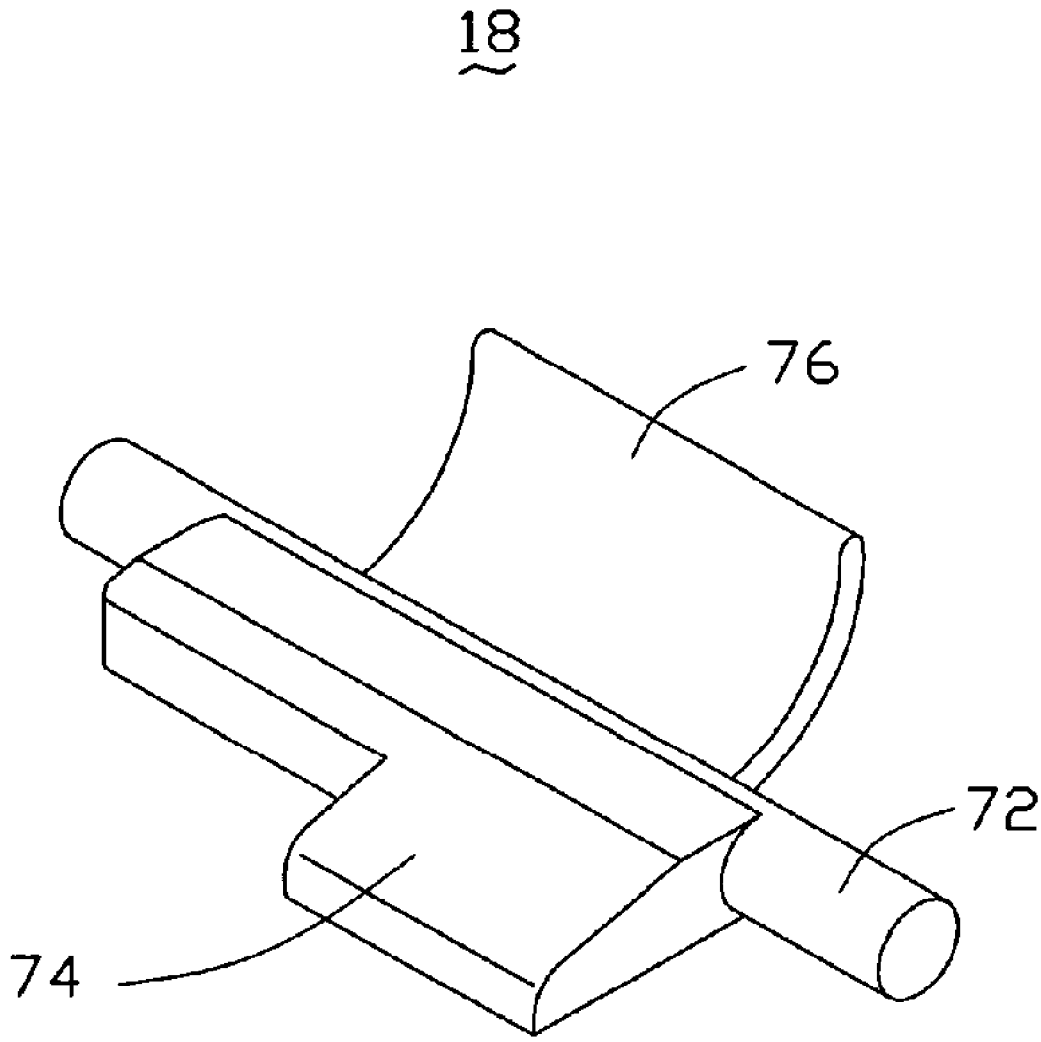
FIG. 5 is an enlarged, isometric view of a resilient lock of FIG. 1.

Referring also to FIG. 5, the resilient lock 18 includes a shaft 72, a second blocking sheet 74, and a resilient sheet 76. The second blocking sheet 74 and the resilient sheet 76 substantially oppositely extend from a circumference of the shaft 72. Two ends of the shaft 72 are inserted into the corresponding fixing holes 35. A location of the second blocking sheet 74 is closer to one end of the shaft 72 than to another end of the shaft 72 so that a second interspace (not labeled) is defined between the second shoulder 28 and the second blocking sheet 74. A length of the second interspace is appreciably greater than that of each first blocking sheet 70 so that there is no interference between each first blocking sheet 70 and the second blocking sheet 74 before any one of the three guiding teeth 64 enters the second receiving groove 42. A width of the second blocking sheet 74 is greater than that of the first baffle sheet 56 so that the second blocking sheet 74 overlaps an edge of the first baffle sheet 56. The second blocking sheet 74 is hindered by the first baffle sheet 56 whilst the resilient sheet 76 resiliently resists the second baffle sheet 58 so that the second blocking sheet 74 can be rotated about the shaft 72 between the first baffle sheet 56 and the second baffle sheet 58.

Figure 6:
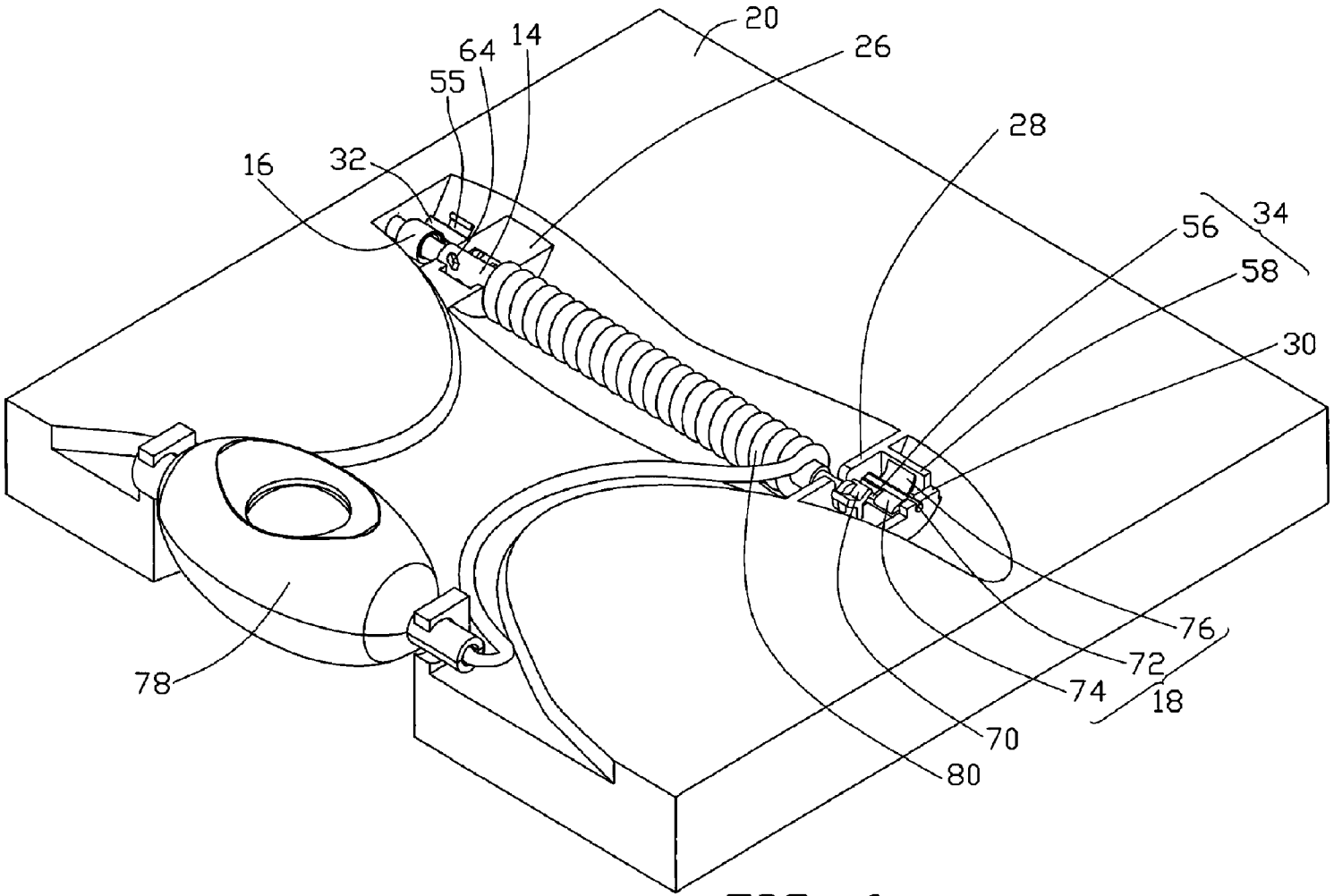
FIG. 6 is an isometric view of the wire winding device of FIG. 1, with a digital camera being mounted therein.

Referring also to FIG. 6, most of the scroll spring 16 is wound around the first end portion 60 of the reel 14 besides the free end 55 being inserted through the first interspace under the fixing sheet 32. The scroll spring 16 can thus interconnect the reel 14 and the first case 20. A width of the scroll spring 16 is less than a length of the first interspace so that there is sufficient distance for the scroll spring 16 to move along a longitudinal direction of the fixing sheet 32.

Figure 7:
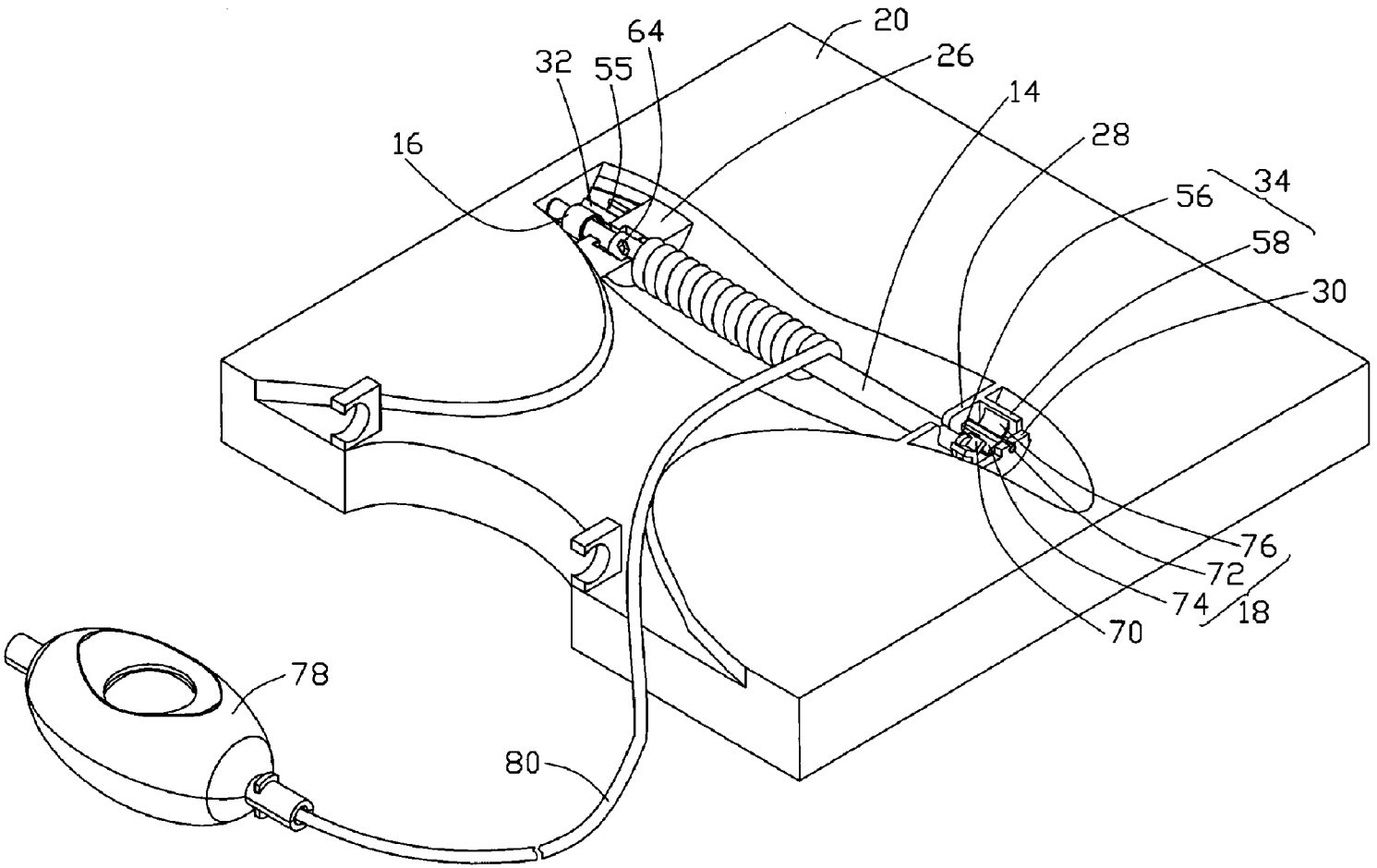
FIG. 7 is an isometric view of the wire winding device of FIG. 6, with the digital camera being drawn out therefrom.

Referring also to FIG. 7, a binding of a digital camera 78 with a wire 80 tailing thereafter and the wire winding device according to the preferred embodiment is illustrated. In use, the wire 80 is received in the first case 20, and most of the wire 80 is wound about the reel 14. The first blocking sheet 70 separates from the second blocking sheet 74. At least one guiding tooth 64 is inserted in the first receiving groove 40. The scroll spring 16 is in a relaxed state. When the digital camera 78 is drawn out from the first case 20, the wire 80 pulls the reel 14 to rotate, the scroll spring 16 is tightened thereby storing energy. Axial and radial motions of the reel 14 are inevitable because of normal manufacturing tolerances of the reel 14 and the fixing holes 35 and friction between the reel 14 and the wire 80. One of the three guiding teeth 64 can thus rotate and move to contact the side of the second wedge subportion 48. Here, the first wedge subportion 46 blocks and forces the guiding tooth 64 to enter the sliding channel 44. This guiding tooth 64 is supposed as a first guiding tooth. The remaining two guiding teeth 64 which follow the rotation of the first guiding tooth 64 are supposed as a second guiding tooth 64 and a third guiding tooth 64. The second guiding tooth 64 rotates and moves to engage with the second inclined surface 52. The reel 14 continues to rotate and move, and then at least one of the guiding teeth 64 enters the second receiving groove 42. One of the three first blocking sheets 70 rotates and moves to contact the second blocking sheet 74. The resilient sheet 76 resiliently resists the second baffle sheet 58. The one of the first blocking sheets 70 is thus baffled by the second blocking sheet 74.

If a desired length is wanted, the wire 80 is continuously pulled until the desired length is exposed. The three guiding teeth 64 rotate in the second receiving groove 42. The first blocking sheets 70 rotate to overcome a resilient force produced by the resilient sheet 76. This causes the second blocking sheet 74 to rotate away to get out of the way for the first blocking sheets 70. The reel 14 can thus be continuously rotated and the wire 80 can be pulled out. When a user slowly stops pulling the wire 80 out, the first blocking sheet 70 is baffled by the second blocking sheet 74, thus the wire 80 is prevented from being retracted.

When it is desired that the wire 80 be retracted, the user need only pull the wire 80 again a short distance causing the reel 14 to rotate at a certain angle, and then the user releases the wire 80 immediately. The scroll spring 16 then causes the reel 14 to rotate in a direction that retracts the wire 80. Reversed axial and radial motions of the reel 14 are inevitable because of normal manufacturing tolerances of the reel 14 and the fixing holes 35, and because of the resilient force of the scroll spring 16 applied to the reel 14. The reel 14 therefore shifts a short distance in the axis direction thereof to separate the first blocking sheet 70 from the second blocking sheet 74 in the axis direction before the first blocking sheet 70 rotates to engage with the second blocking sheet 74. The three guiding teeth 64 return from the second receiving groove 42 to the first receiving groove 40 via the sliding channel 44 and the first inclined surface 50. Then, the reel 14 rotates freely in the first receiving groove 42 until the wire 80 is entirely rewound.

In alternative embodiments, the numbers of the guiding teeth 64 and the first blocking sheets 70 are not limited to three, the corresponding numbers may be two, four or other. In addition, a connection between the scroll spring 16 and the first case 20 are not limited to a usage of the fixing sheet 32. A long slot may be defined in the scroll spring 16 near to the free end 55. A pin or screw may be inserted through the long slot and fixed in the recess portion 24. Furthermore, a plurality of blocking grooves can be defined in the circumference of the reel 14 instead of the first blocking sheets 70 to detachably receive the second blocking sheet 74. The resilient lock 18 may include a blocking sheet and a resilient sheet fixed with the blocking sheet. One end of the resilient sheet is secured in the second baffle sheet 58, while one end of the blocking sheet selectively blocks the first blocking sheets 70 or is received in the blocking grooves. Still further, the shaft 72 and the third shoulder 30 may be omitted. Moreover, the wire winding device may also be applied in a keyboard, a mouse, a telephone or the like, and the housing 12 may be directly adopted as a shell of the keyboard, the mouse, the telephone or the like.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A wire winding device comprising:

a case defining a first receiving groove, a second receiving groove, and a sliding channel communicating the first receiving groove with the second receiving groove;

a reel received in the case and configured for winding a wire thereon by rotation of the reel in a winding direction perpendicular to an axial direction of the reel, the reel comprising at least one guiding protrusion configured for alternatively shifting into the first receiving groove and the second receiving groove by guidance of the sliding channel;

a restricting member arranged on the case and configured for hindering/releasing the reel; and a resilient member configured for interconnecting the case and the reel and tending to rotate the reel in the winding direction and being movable with the reel in the axial direction of the reel when the reel starts to rotate;

wherein the reel is movable in the axial direction between a first position where the at least one guiding protrusion passes through the sliding channel from the first receiving groove into the second receiving groove and the restricting member blocks the reel from rotating in the winding direction but allows the reel to rotate in an unwinding direction counter to the winding direction to unwind the wire, and a second position where the at least one guiding protrusion passes through the sliding channel from the second receiving groove into the first receiving groove and the restricting member releases the reel to allow the reel to freely rotate in the winding direction during resilient release of the resilient member.

2. The wire winding device as claimed in claim 1, wherein the reel comprises at least one first blocking portion formed on the circumference of the reel for being detachably restricted by the restricting member.

3. The wire winding device as claimed in claim 1, wherein a wedge portion is arranged in the case, the first receiving groove and the second receiving groove are defined at two opposite sides of the wedge portion, and the sliding channel is defined through the wedge portion.

4. The wire winding device as claimed in claim 1, wherein a free end of the resilient member is joined to the case and movable along the axial direction of the reel.

5. The wire winding device as claimed in claim 2, wherein the restricting member comprises a second blocking portion for detachably engaging with the at least one first blocking portion while the at least one guiding protrusion completely enters the second receiving groove, and a resilient portion for resiliently restricting a rotation of the second blocking portion, the at least one first blocking portion being released from the second blocking portion before the at least one guiding protrusion completely enters the second receiving groove.

6. The wire winding device as claimed in claim 5, wherein a baffle member comprises a first baffle portion for detachably hindering the second blocking portion and a second baffle portion perpendicularly extending from the first baffle portion for supporting the resilient portion.

7. A wire winding device comprising:

a case comprising a first bearing portion, a second bearing portion, and a recess portion, the first bearing portion and the second bearing portion being arranged in the recess portion, a first receiving groove and a second receiving groove being defined in the first bearing portion;

a reel received in the recess portion for winding a wire thereon, the reel comprising a plurality of guiding protrusions extending from the outer circumference of the reel for alternatively shifting into the first receiving groove and the second receiving groove, and a plurality of first blocking portions extending from the outer circumference of the reel, the plurality of guiding protrusions and the plurality of first blocking portions being located at two opposite end portions of the reel;

a resilient lock pivotally arranged on the case beside the second bearing portion for detachably engaging with the plurality of first blocking portions; and a scroll spring interconnecting the case and the reel for rewinding the wire.

8. The wire winding device as claimed in claim 7, wherein the first bearing portion comprises a wedge portion, the first receiving groove and the second receiving groove are arranged at two opposite sides of the wedge portion.

9. The wire winding device as claimed in claim 7, wherein the resilient lock comprises a second blocking portion for detachably hindering the first blocking portion and a resilient sheet for resiliently restricting a rotation of the second blocking portion.

10. The wire winding device as claimed in claim 7, wherein a free end of the scroll spring is joined to the case and movable along the axial direction of the reel.

11. The wire winding device as claimed in claim 8, wherein a sliding channel is defined through the wedge portion for communicating the first receiving groove and the second receiving groove and for the plurality of guiding protrusions to move therethrough.

12. The wire winding device as claimed in claim 11, wherein the sliding channel divides the wedge portion into a first wedge subportion and a second wedge subportion, the first wedge subportion and the second wedge subportion are staggered along the axial direction of the reel for entrance of the plurality of guiding protrusions.

13. The wire winding device as claimed in claim 12, wherein the first wedge subportion includes a first inclined surface adjacent to the first receiving groove and oriented such that a lower end of the first inclined surface is nearest the first receiving groove, the second wedge subportion includes a second inclined surface adjacent to the second receiving groove and oriented such that a lower end of the second inclined surface is nearest the second receiving groove, the first inclined surface and the second inclined surface are configured for guiding the plurality of guiding protrusions.

14. The wire winding device as claimed in claim 13, wherein each guiding protrusion is generally prism shaped and comprises two opposite parallel sides for conforming with and sliding along the first inclined surface and the second inclined surface.

15. The wire winding device as claimed in claim 9, wherein an interspace is defined between the second bearing portion and the second blocking portion for the first blocking portions passing therethrough, a length of the interspace is appreciably greater than that of the first blocking portions so that there is no interference between each first blocking portion and the second blocking portion before any one of the guiding protrusions completely enters the second receiving groove.

16. The wire winding device as claimed in claim 15, wherein a baffle member connects to the second bearing portion, and comprises a first baffle sheet for detachably hindering the second blocking portion and a second baffle sheet perpendicularly extending from the first baffle sheet for supporting and resisting the resilient sheet.

17. The wire winding device as claimed in claim 16, wherein the second blocking portion overlaps an edge of the first baffle sheet so that the second blocking portion is capable of detachably hindering the first blocking portions.

18. A wire winding device comprising:

a case comprising a first bearing portion, a second bearing portion, and a recess portion, the first bearing portion and the second bearing portion being arranged in the recess portion and spaced from each other, a first receiving groove and a second receiving groove being defined in the first bearing portion with a guiding structure formed therebetween;

a resilient lock pivotally attached to the second bearing portion;

a reel pivotably attached between the first and second bearing portions for winding a wire thereon, the reel comprising a guiding protrusion and first blocking portion extending from a circumference of the reel, the guiding protrusion and the first blocking portion being located at two opposite end portions of the reel; and a spring member interconnecting the case and the reel for winding the wire; wherein when the reel is rotated in a first direction to unwind the wire the guiding protrusion is guided by the guiding structure from the first receiving groove to enter the second receiving groove to drive the reel to move in an axis direction of the reel and to cause the first blocking portion to be engagable with the resilient lock.

19. The wire winding device as claimed in claim 18, wherein when the reel is rotated in a second direction to wind the wire the guiding protrusion is guided by the guiding structure from the second receiving groove to enter the first receiving groove to drive the reel to move in a reversed axis direction of the reel and to cause the first blocking portion to separate from the resilient lock in the axis direction of the reel so that the reel is rotatable freely to wind the wire.

20. The wire winding device as claimed in claim 18, wherein when the reel is rotated in a first direction an external force is needed to overcome a resilient force of the resilient lock.

* * * * *